US005263887A

United States Patent [19]

Cagna et al.

[11] Patent Number: 5,263,887

[45] Date of Patent: Nov. 23, 1993

[54] METHOD OF FORMING A COLOR PICTURE TUBE SHADOW MASK

[75] Inventors: Nicola D. Cagna, Rome; Carlo L. Fonda, Anagni, both of Italy

[73] Assignee: Videocolor S.p.A., Anagni, Italy

[21] Appl. No.: 667,156

[22] Filed: Mar. 11, 1991

[51] Int. Cl.[5] ..... H01J 9/12

[52] U.S. Cl. ..... 445/47; 445/49; 72/348

[58] Field of Search ..... 445/37, 49, 47; 72/347, 72/348

[56] References Cited

U.S. PATENT DOCUMENTS

| | | | |
|---|---|---|---|
| 3,855,493 | 12/1974 | Snook et al. | 313/402 |
| 4,536,226 | 8/1985 | Ohtake et al. | 445/47 |
| 4,615,205 | 10/1986 | Ragland, Jr. | 72/347 |
| 4,719,787 | 1/1988 | Ragland, Jr. | 72/347 |
| 4,746,315 | 5/1988 | Sumiyoshi | 445/37 |
| 4,754,635 | 7/1988 | van den Berg et al. | 72/350 |
| 4,792,318 | 12/1988 | Igaki et al. | 445/66 |
| 4,890,471 | 1/1990 | Ito | 72/348 |

FOREIGN PATENT DOCUMENTS

| | | | |
|---|---|---|---|
| 0224296 | 6/1987 | European Pat. Off. | 445/37 |
| 0246838 | 11/1987 | European Pat. Off. | 445/37 |
| 54-98567 | 8/1979 | Japan | 445/47 |
| 54-157470 | 12/1979 | Japan | 445/47 |

*Primary Examiner*—Richard K. Seidel
*Assistant Examiner*—Jeffrey T. Knapp
*Attorney, Agent, or Firm*—Joseph S. Tripoli; Dennis H. Irlbeck

[57] ABSTRACT

The present invention provides an improved method of forming a shadow mask for a color picture tube from a flat apertured mask. The mask has an central apertured portion, a solid border portion and a skirt portion. The improved method comprises several steps. First, a flat apertured mask is placed beneath an upper punch. Next, the periphery of the mask at the skirt portion is clamped. The punch then is pressed against the mask to contour the mask in its central apertured and solid border portions. Thereafter, the periphery of the mask at the skirt portion is unclamped, and the solid border portion of the mask is pressed between a bead die and the punch to form a peripheral bead in the solid border portion of the mask. Finally, the skirt portion is swept back to substantially parallel a central longitudinal axis of the formed mask, while the border portion is held between the bead die and the punch.

2 Claims, 7 Drawing Sheets

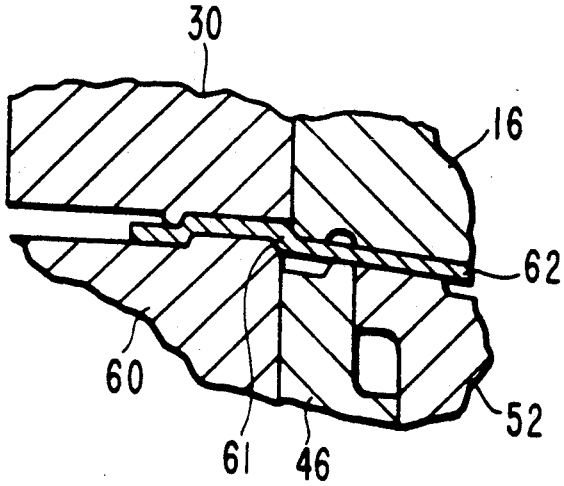
FIG. 6
FIG. 7
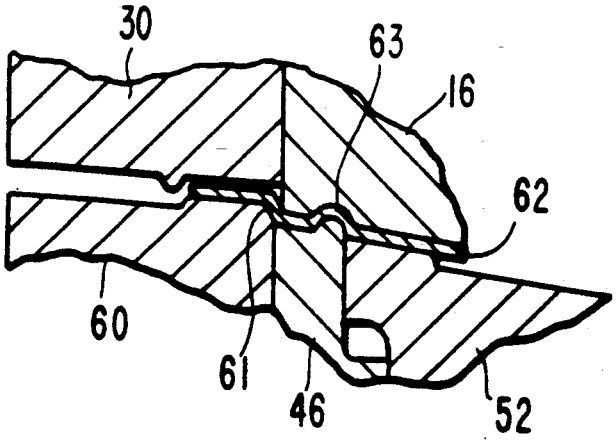

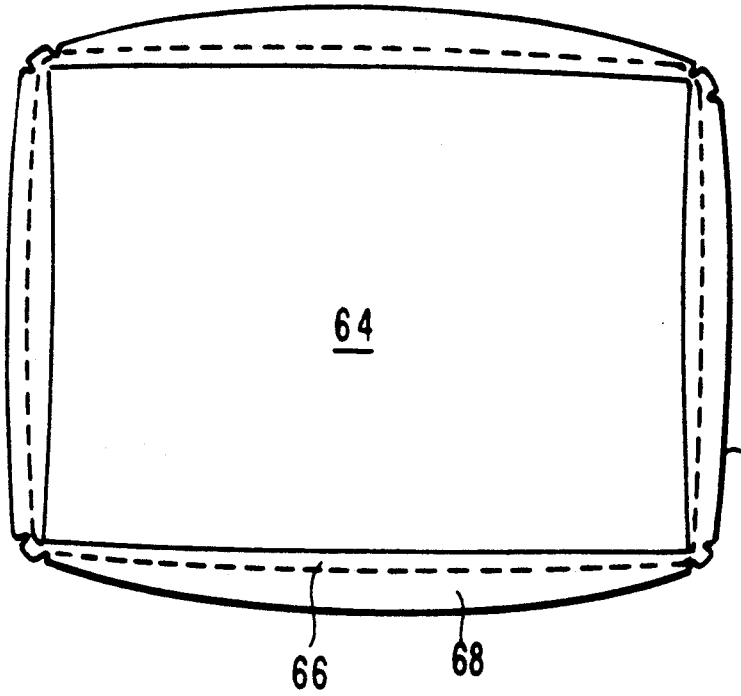
FIG. 8
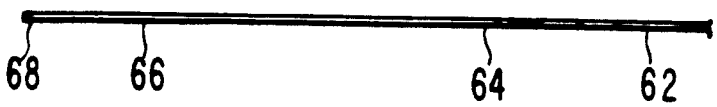
FIG. 9
FIG. 10
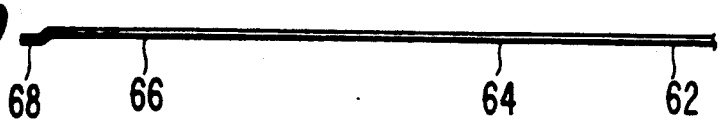
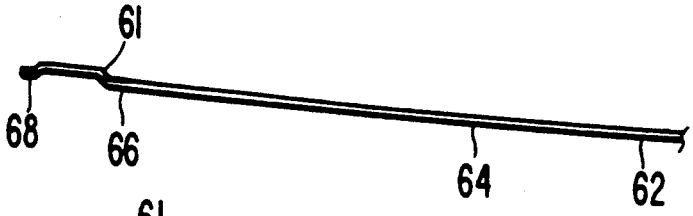
FIG. 11
FIG. 12
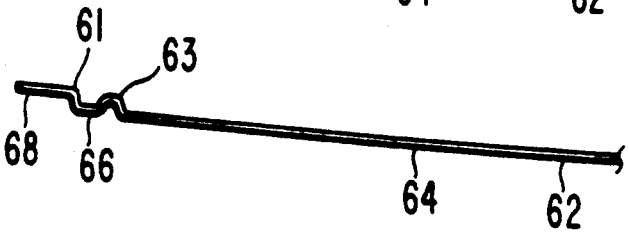
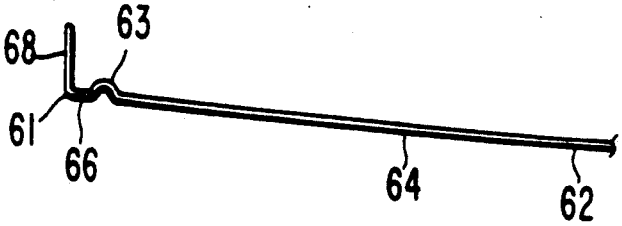
FIG. 13

METHOD OF FORMING A COLOR PICTURE TUBE SHADOW MASK

This invention relates to methods for forming shadow masks for color picture tubes, and particularly to a method for forming such a mask having a bead located in a border portion between an apertured portion of the mask and a peripheral skirt of the mask.

BACKGROUND OF THE INVENTION

A color picture tube includes an electron gun for forming and directing three electron beams to a screen of the tube. The screen is located on the inner surface of a faceplate of the tube and is made up of an array of elements of three different color emitting phosphors. An apertured mask, called a shadow mask, is interposed between the gun and the screen to permit each electron beam to strike only the phosphor elements associated with that beam.

A shadow mask is a thin sheet of metal, such as steel, that is contoured to somewhat parallel the inner surface of the tube faceplate. The shadow mask includes a large central apertured portion, a solid border portion surrounding the apertured portion and a peripheral skirt portion. The skirt portion is angled from the other portions of the mask and is usually welded to a peripheral frame that supports the mask within a tube.

In making a shadow mask, a flat sheet of metal is etched to form the apertures, which are usually elongated slots or circular holes. Thereafter, the sheet is formed into the desired contour, such as spherical or biradial, and a skirt is formed by sweeping back the peripheral edge of the sheet. During mask forming, it is sometimes desirable to include a peripheral U-shaped bead in the border area of the mask to provide reinforcement of the mask, particularly to prevent or minimize mask buckling during tube operation, when the masks expands.

In a prior conventional method of forming a shadow mask, a flat apertured mask first is clamped around its peripheral edges and a die presses the mask against a pad to form the mask contour. A bead is formed in the mask by including a peripheral groove and protrusion on the punch and pad, respectively, to form the bead at the same time the mask contour is formed. One problem with this prior method is that, during forming of the bead, material is stretched on both sides of the bead. This stretching often causes the mask apertures at the edge of the apertured portion to also stretch. Such stretching of the apertures may rupture tie bars between apertures or may stretch the sizes of the apertures beyond design limits. Therefore, there is a need for a method of forming a shadow mask with a bead that will not cause a stretching of the apertured portion because of the addition of the bead to the mask. The present invention accomplishes this result by a method that forms a bead in a separate step that does not stretch the apertured portion of a shadow mask.

SUMMARY OF THE INVENTION

The present invention provides an improved method of forming a shadow mask for a color picture tube from a flat apertured mask. The mask has an central apertured portion, a solid border portion and a skirt portion. The improved method comprises several steps. First, a flat apertured mask is placed beneath a punch. Next, the periphery of the mask at the skirt portion is clamped.

The punch then is pressed against the mask to contour the mask in the central apertured and solid border portions. Thereafter, the periphery of the mask at the skirt portion is unclamped and the solid border portion of the mask is pressed between a bead die and the punch to form a peripheral bead in the solid border portion of the mask. Finally, the skirt portion is swept back to substantially parallel a central longitudinal axis of the formed mask, while the border portion is held between the bead die and the punch.

BRIEF DESCRIPTION OF THE DRAWINGS

FIGS. 6 and 7 are enlarged axially sectioned side views showing greater detail of the stages of mask forming shown in FIGS. 3 and 4, respectively.

FIG. 8 is a plan view of a flat unformed shadow mask.

FIGS. 9, 10, 11, 12 and 13 are axial section views of a shadow mask during the various stages of forming shown in FIGS. 1, 2, 3, 4 and 5, respectively.

DETAILED DESCRIPTION OF THE PREFERRED EMBODIMENTS

Figure 1:
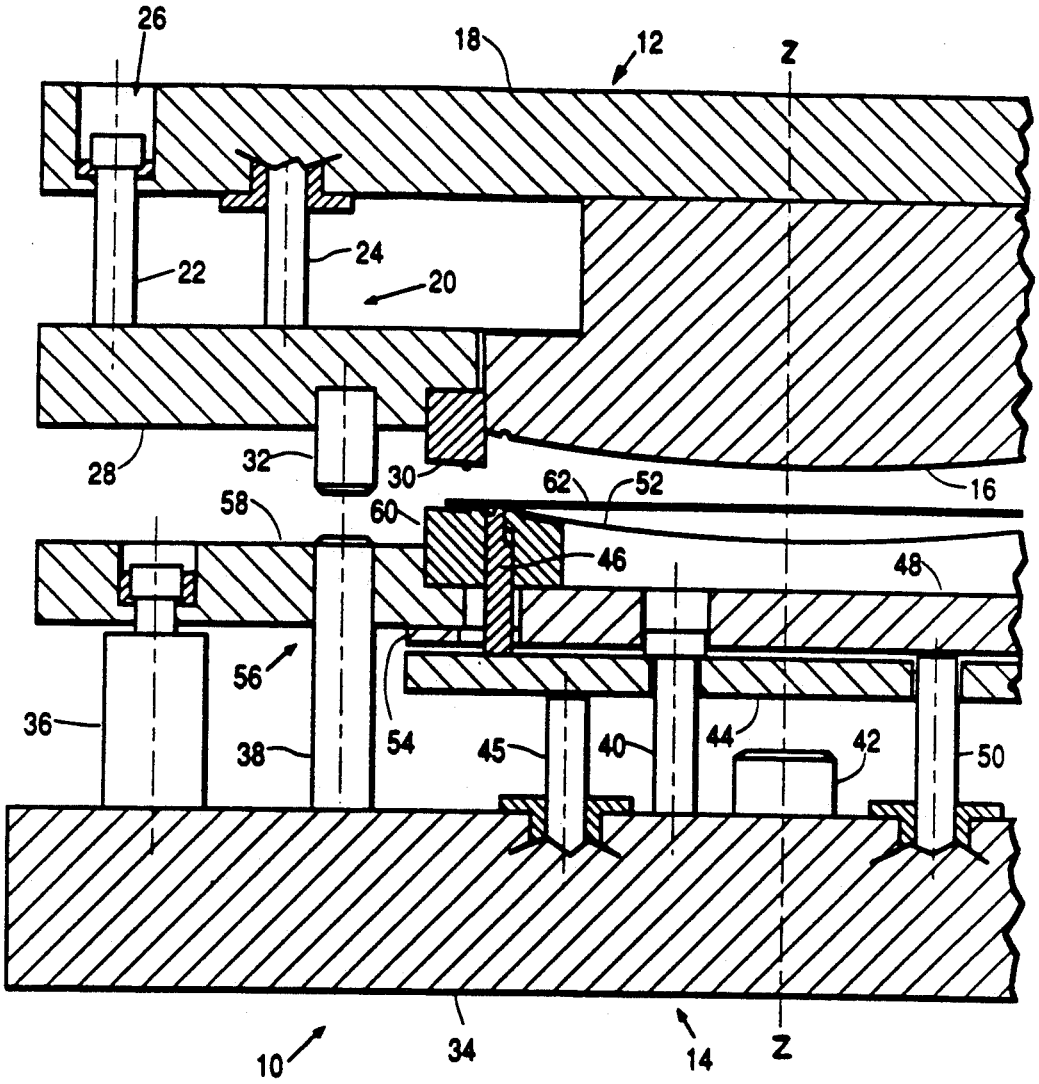
FIGS. 1, 2, 3, 4 and 5 are axially sectioned side views of a shadow mask press in various stages of mask forming.

The parts of a shadow mask press 10 are shown in FIGS. 1, 2, 3, 4 and 5. The two major parts are the upper punch assembly 12 and the lower die assembly 14. The upper punch assembly 12 includes a punch 16 having a bottom surface which is shaped in contour similar to the desired shadow mask shape. There is some difference in contour between the punch 16 and desired mask shape to allow for material spring-back after the mask is formed. The punch 16 is attached to an upper plate 18 that in turn is connected to the remainder of the press, which is not shown. A pressure ring subassembly 20, surrounding the punch 16, is slidably mounted to the upper plate 18 by a shaft 22. A hydraulic cylinder 24 moves the subassembly away from the upper plate 18. The end of the shaft 22 is wider than the remainder of the shaft 22 and serves as a stop at the bottom of a recess 26 in the plate 18. The subassembly 20 includes a support plate 28 and a pressure ring 30. The pressure ring 30 is located in sliding contact with the side of the punch 16. The support plate 28 includes a fixed stop shaft 32 that extends downward therefrom.

The lower die assenbly 14 includes a lower plate 34 that has four fixed stop shafts 36, 38, 40 and 42 extending upwardly therefrom. The stop shaft 38 is aligned with the stop shaft 32 in the upper subassembly 20, and contact of the two shafts 32 and 38 restricts the downward movement of the upper subassembly 20. Just above the lower plate 34 is a bead die support plate 44. The support plate 44 is moved relative to the lower plate 34 by a hydraulic cylinder 45 that extends from the lower plate 34. Upward movement of the support plate 44, relative to the lower plate 34, is restricted by a wider upper end of the stop shaft 40. Downward movement of the support plate 44 is restricted by the bottom stop shaft 42. An upward extending bead die 46 is fixed to the upper surface of the support plate 44.

Just above the bead die support plate 44 is a die support plate 48. The support plate 48 is moved upwardly by a hydraulic cylinder 50 that extends from the lower plate 34 up through an aperture in the support plate 44. A die 52 is fixed to the support plate 48. A ledge 54, extends from the support plate 48 to provide support for a lower subassembly 56 when the plate 48 is in its upper position. The lower subassembly 56 includes a wiper support plate 58 that is biased upwardly by the ledge 54 of the support plate 48, but restricted in upward and downward movement by wider portions of the stop shaft 36. There is an aperture in the plate 58 through which the stop shaft 38 passes. A wiper 60 is fixed to the plate 58 in a position directly below the pressure ring 30. The line Z—Z in the drawings indicates the central longitudinal axis of both the press 10 and the shadow mask 62.

Figure 2:
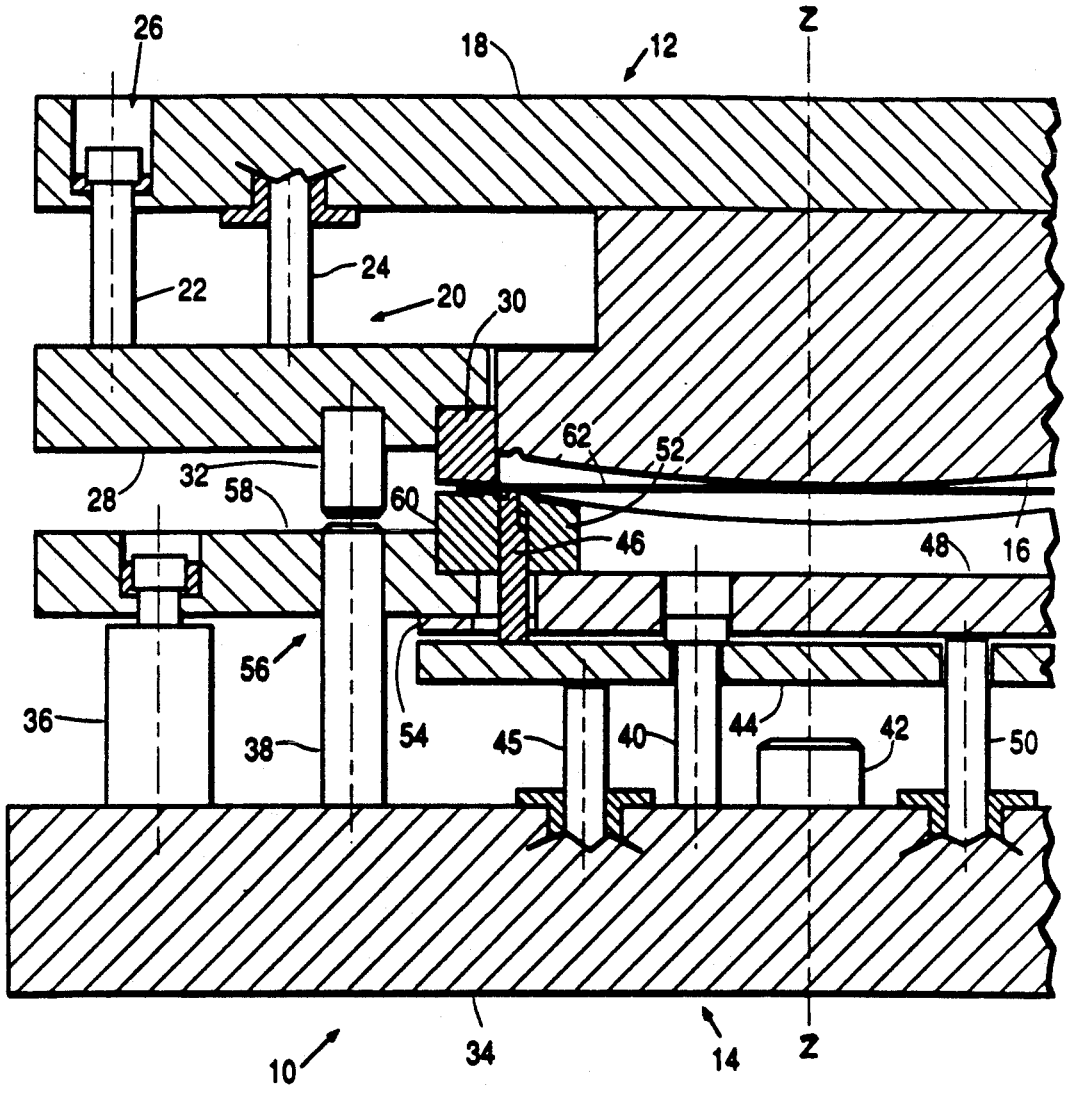
Figure 3:
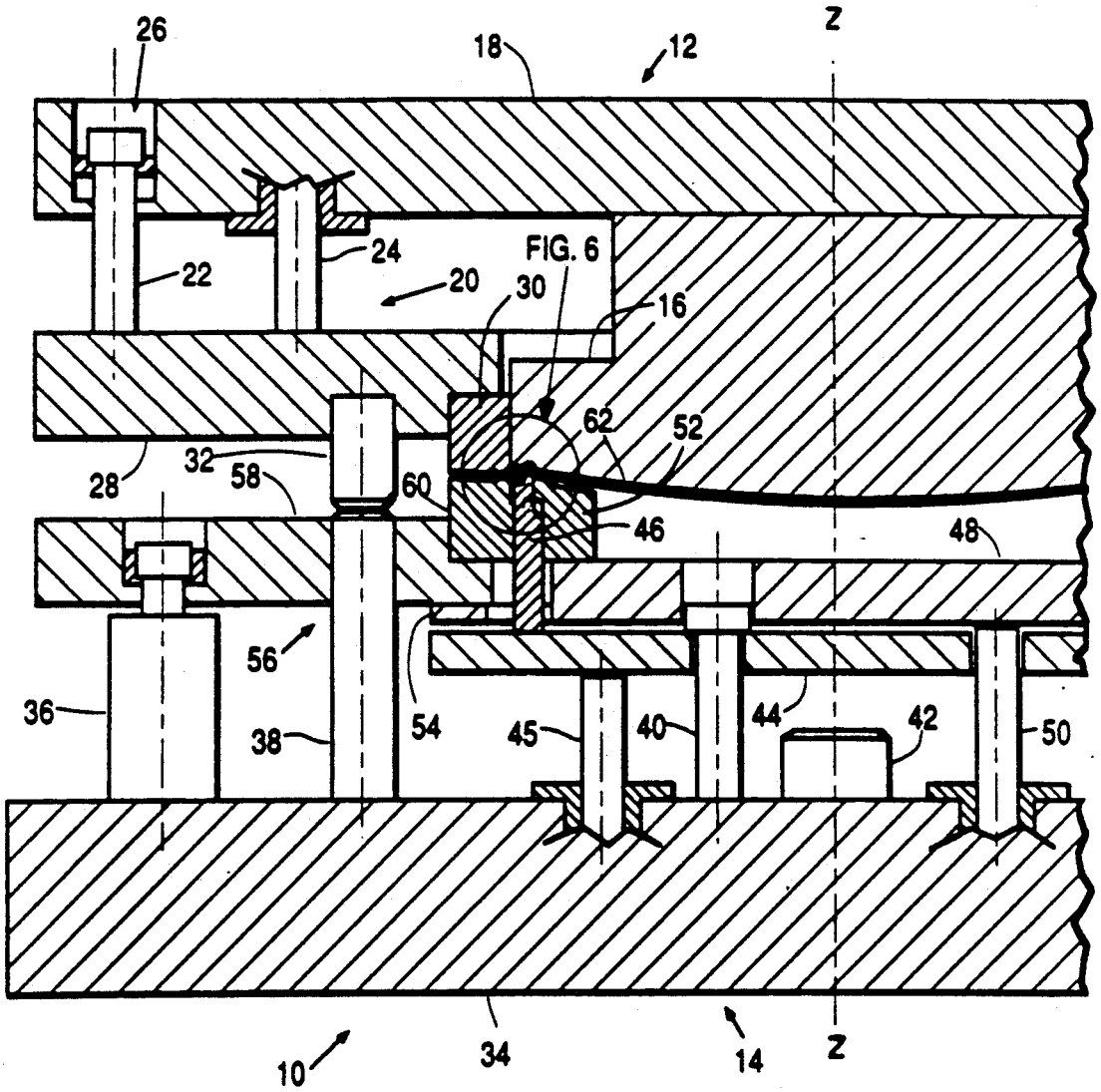

With the upper punch assembly 12 and lower die assembly 14 separated, a flat shadow mask 62 is placed on the wiper 60 and lower die assembly 14, as shown in FIG. 1. Next, the upper punch assembly 12 is lowered until the pressure ring 30 contacts the periphery of the shadow mask 62 that rests on the wiper 60, as shown in FIG. 2. At this stage, the periphery of the mask 62 is clamped between the pressure ring 30 and the wiper 60 and, as pressure is applied, the stop shaft 32 contacts the stop shaft 38. Next, with the exception of the pressure ring subassembly 20, which is held in position from further downward movement by the two stop shafts 32 and 38, the upper punch assembly 12 is lowered, thereby pressing the punch 16 against the flat shadow mask 62 to form the mask, as shown in FIG. 3. Greater detail of the upper punch assembly 30, wiper 60 and shadow mask 62, at this step, usually referred to as the prewipe step, is shown in FIG. 6. As shown in FIG. 6, a slight bend 61 of about 0.5 to 1.5 mm is formed in the mask 62. The bend 61 is the beginning of the mask skirt which is further formed at a later step.

Figure 4:
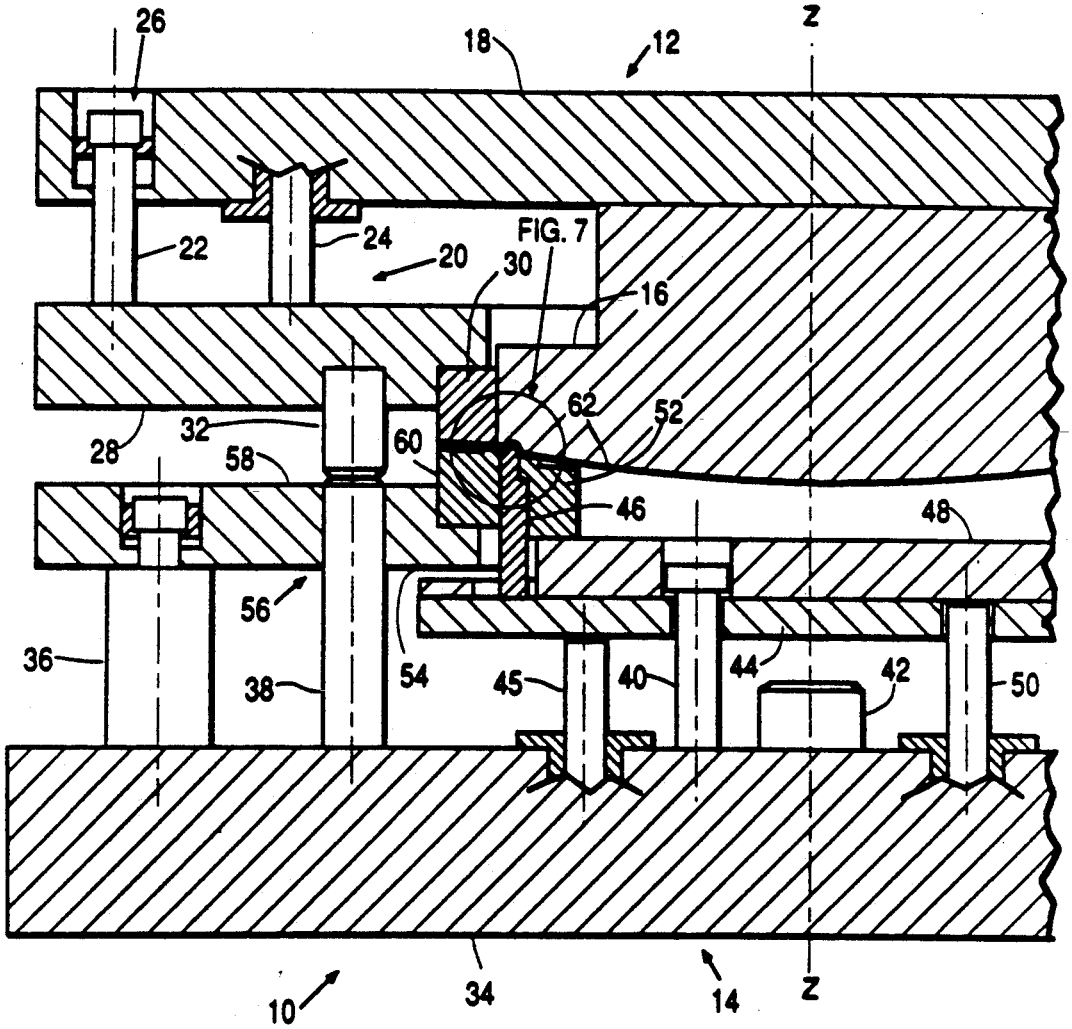

As the punch 16 continues downward, a force is exerted through the mask 62 against the wiper 60, causing the lower subassembly 56 to move slightly downward and thereby releasing the clamping pressure on the periphery of the mask. Relaxation of the clamping pressure then permits lateral movement of the periphery of the mask 62 between the pressure ring 30 and the wiper 60. Thereafter, downward motion of the punch 16 is continued, causing the bead die 46 to apply a force against the mask and form a bead 63 in the mask, as shown in FIG. 4. Greater detail of this bead forming step is shown in FIG. 7. By comparing FIGS. 6 and 7, it can be seen that material for forming the bead 63 comes from the loose periphery of the mask 62, shown on the left, and that the center portion of the mask, shown on the right, is clamped between the punch 16 and the die 52.

Figure 5:
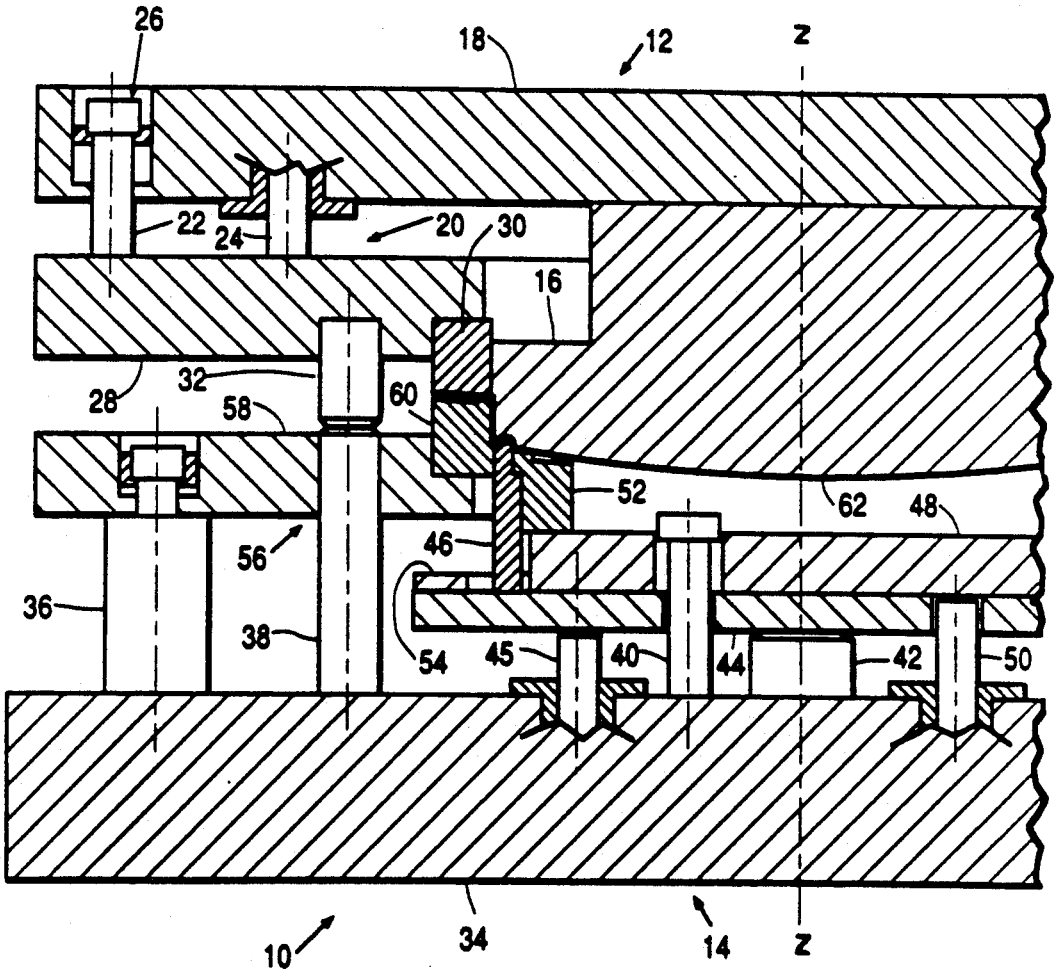

At this step, further downward movement of the punch 16 causes the wiper support plate 58 to move downward against the bottom stop of the stop shaft 36, where movement of the plate 58 and the attached wiper 60 ceases. Once downward movement of the wiper 60 stops, further downward movement of the punch 16 sweeps the punch 16 along the wiper 60, causing the periphery of the mask 62 to extend upward in the space between the punch 16 and wiper 60, thereby forming the skirt of the mask 62, as shown in FIG. 5. Downward movement of the punch 16 ceases when the bottom of the support plate 44 contacts the stop shaft 42.

FIG. 8 shows one surface of the flat unformed shadow mask 62, and FIGS. 9, 10, 11, 12 and 13 show the shadow mask 62 at various stages of forming corresponding to FIGS. 1, 2, 3, 4 and 5, respectively. The shadow mask 62 includes an apertured portion 64, a solid border portion 66 and a skirt portion 68. FIG. 9 shows the flat shadow mask 62 as it is positioned under the punch 16. FIG. 10 shows the mask 62 as the skirt portion 68 is clamped between the pressure ring 30 and wiper 60. FIG. 11 shows the mask 62 as the apertured portion 64 and the border portion 66 are contoured by the punch 16, and as the edge of the punch 16 begins to form the corner of the mask skirt, i.e., at. the prewipe step. FIG. 12 shows the mask 62 when the skirt portion 68 is unclamped and the bead 63 is formed. FIG. 13 shows the mask 62 after the skirt portion is swept to substantially parallel the longitudinal axis Z—Z of the mask.

The above-described method of forming a mask having a peripheral bead has several advantages over prior methods, the primary advantage being that it prevents any misshaping of the mask apertures during insertion of the bead. Also, the die can work with only one hydraulic device instead of the two usually used in the art. Therefore, the cost of a press using the present method can be reduced.

What is claimed is:

1. In an improved method of forming a shadow mask for a color picture tube from a flat apertured mask, said mask having an apertured central portion, a solid border portion and a skirt portion, the improvement comprising firstly, placing a flat apertured mask beneath an upper punch, secondly, clamping the periphery of said mask at said skirt portion, thirdly, pressing said punch against said mask to contour said mask in said central apertured and solid border portions, fourthly, unclamping said periphery of said mask at said skirt portion, fifthly, pressing said solid border portion of said mask between a bead die and the punch to form a peripheral bead in said solid border portion of said mask, and sixthly, sweeping said skirt portion to substantially parallel a central longitudinal axis of the formed mask, while continuing to press said solid border portion of said mask between said bead die and said punch.

2. In an improved method of forming a shadow mask for a color picture tube from a flat apertured mask, said mask having an apertured central portion, a solid border portion and a skirt portion, the improvement comprising firstly, placing a flat apertured mask beneath an upper punch, secondly, clamping the periphery of said mask at said skirt portion, thirdly, pressing said punch against said mask to contour said mask in said central apertured and solid border portions, and to form a bend in said mask between said solid border portion and said skirt portion, fourthly, unclamping said periphery of said mask at said skirt portion, fifthly, pressing said solid border portion of said mask between a bead die and said punch to form a peripheral bead in the solid border portion of said mask, and sixthly, sweeping said skirt portion to increase the bend between said border portion and said skirt portion, while continuing to press said solid border portion of said mask between said bead die and said punch, until said skirt portion substantially parallels a central longitudinal axis of the formed mask.

* * * * *

UNITED STATES PATENT AND TRADEMARK OFFICE

CERTIFICATE OF CORRECTION

PATENT NO. : 5,263,887

DATED : November 23, 1993

INVENTOR(S) : Nicola Della Cagna et al

It is certified that error appears in the above-indentified patent and that said Letters Patent is hereby corrected as shown below:

ON THE TITLE PAGE:

In the Abstract:

Under the words, "UNITED STATES PATENT [19]",

"Cagna et al.", should read

-- Della Cagna et al. -- ; and

In Item [75] Inventors: "Nicola D. Cagna,"

should read -- Nicola Della Cagna -- .

Signed and Sealed this

Twenty-fifth Day of July, 1995

*Attest:*

BRUCE LEHMAN

*Attesting Officer*

*Commissioner of Patents and Trademarks*